United States Patent [19]

Funaki

[11] Patent Number: 4,926,611

[45] Date of Patent: May 22, 1990

[54] METHOD OF ASSEMBLING A ROOF STRUCTURE

[76] Inventor: Motokatsu Funaki, 430 Shimotsuchidana, Fujisawa-shi, Kanagawa-ken, Japan

[21] Appl. No.: 223,579

[22] Filed: Jul. 25, 1988

Related U.S. Application Data

[62] Division of Ser. No. 910,576, Sep. 23, 1986, Pat. No. 4,803,818.

[30] Foreign Application Priority Data

| | | | |
|---|---|---|---|
| Sep. 26, 1985 | [JP] | Japan | 60-210958 |
| Sep. 26, 1985 | [JP] | Japan | 60-210959 |
| Dec. 16, 1985 | [JP] | Japan | 60-280999 |

[51] Int. Cl.[5] ..... E04G 21/14

[52] U.S. Cl. ..... 52/748; 52/747

[58] Field of Search ..... 52/748, 747, 47, 54, 52/55, 57, 520

*Primary Examiner*—Michael Safavi

*Attorney, Agent, or Firm*—Blum Kaplan

[57] ABSTRACT

A roof structure is disclosed which is capable of accomplishing an improvement in workability, ensuring safety in the assemblying operation and preventing leakage of rain. The roof structure is assembled by engaging an eaves side connection of ridge side one of each adjacent two roof boards with a ridge side connection of eaves side one of the roof boards and securely holding the eaves side and ridge side connections engaged together by means of a fixture fixed on a common rafter at a position on the eaves side beyond the eaves side connection of the ridge side roof board and securely held in the eaves side connection engaged with the ridge side connection.

1 Claim, 11 Drawing Sheets

METHOD OF ASSEMBLING A ROOF STRUCTURE

This is a division of application Ser. No. 910,576, filed Sep. 23, 1986, currently pending—now U.S. Pat. No. 4,803,818 2/14/89.

BACKGROUND OF THE INVENTION

1. Field of the Invention

This invention relates to a roof structure and a fixture therefor, and more particularly to a roof structure assembled by connecting a plurality of roof boards to one another in turn from a ridge side to an eaves side and a fixture used for assembling such a roof structure.

2. Description of the Prior Art

Important problems to be solved in the assembling of a roof structure which is carried out by connecting roof boards to one another in turn in the slanting direction of a roof are that rainwater must be prevented from entering through an engagement between each adjacent two roof boards into the roof structure and the roof boards must be prevented from being lifted due to blowing-up of wind.

Conventionally, the assembling of a roof structure in a slanting direction of a roof is carried out by connecting roof boards to one another in turn from an eaves side to a ridge side. For such assembling, as shown in FIGS. 1(A) to 1(D), a fixture 38 formed of a metal material is used to securely hold an upper side or ridge side connection of each of roof boards 30. Also, the fixture 38 is fixed on a common rafter 34 at a position on a ridge side beyond the ridge side connection of the roof board 30, as shown in FIG. 1. Accordingly, when it blows hard and rains heavily, the fixture is often lifted due to blowing-up of wind, resulting in failing to provide the roof structure with waterproofness. In view of the above, it is desired to improve the fixture from a viewpoint of both its structure and its fixed position.

Also, the conventional roof structure assembling operation is typically carried out in a manner to form scaffolding around a roof and connect a plurality of roof boards to one another in turn from an eaves side to a ridge side while mounting each of the roof boards, by means of such a fixture fixed on a roof support means such as a common rafter arranged on a purlin.

However, such conventional assembling is highly troublesome and dangerous particularly when a slant is steep, because the roof boards must be upwardly connected from the eaves side to the ridge side. Also, roof boards which have been connected are used as scaffolding and/or a yard for further connection of other roof boards, resulting in being damaged. In addition, the conventional assembling operation requires much labor to lift roof boards because it must be upwardly carried out from the eaves side to the ridge side. Further, the conventional assembling causes an uppermost roof board of the assembled roof structure to be apt to make a dimensional error at a position of a ridge side rising support means. This renders the operation of fixing the uppermost roof board through a holding member onto the ridge side rising support means highly troublesome, resulting in leakage of rain often occurring at a connection between the uppermost roof board and the ridge side rising support means. The leakage causes a serious problem as compared with that at the eaves side of the roof structure. Furthermore, the fixture for each roof board is adapted to downwardly hold the ridge side connection of the roof board by means of a holding section thereof extending from the ridge side to the eaves side and has a base section fixed on a common rafter at a position on the ridge side beyond an engagement between adjacent two roof boards, so that the fixture fails to exhibit strength sufficient to bear force applied thereto when blowing-up wind strikes to the engagement between the roof boards, resulting in damage of the roof structure and leakage of rain.

Accordingly, there is a need for a roof structure which is capable of being assembled by connecting roof boards to one another from a ridge side to an eaves side to improve workability and prevent leakage of rain and a fixture for effectively assembling such a roof structure.

SUMMARY OF THE INVENTION

Generally speaking, in accordance with one aspect of the present invention, a roof structure is provided which includes a plurality of roof boards connected to one another in turn from a ridge side to an eaves side and mounted on a roof support means such as common rafters or the like. The roof boards each comprises a flat surface section, and a ridge side connection and an eaves side connection provided on both ends of the flat surface section in a manner to interpose the flat surface section therebetween. The connection between each adjacent two of the roof boards are accomplished by engaging the eaves side connection of ridge side one of the adjacent two roof boards with the ridge side connection of the eaves side roof board. The roof structure also includes a fixture fixed on the roof support means at a position on the eaves side beyond the ridge side connection of each of the roof boards.

Also, in accordance with another aspect of the present invention, a fixture for a roof structure is provided which is adapted to securely connect roof boards to one another in turn from a ridge side to an eaves side and mount the roof boards therethrough on a roof support means. The fixture includes a base section fixed on the roof support means at a position on the eaves side beyond an eaves side connection of each of the roof boards, a holding section upwardly extending from a ridge side end of the base section and a support section formed by bending a distal end portion of the holding section in the eaves side direction and adapted to support an eaves side end portion of a flat surface section of the roof board thereon and be securely held in the eaves side connection of the roof board. The fixture is formed into a substantially C-shape to provide therein an internal space which is sufficient to facilitate therein the insertion a ridge side connection of the lower side roof board of each adjacent two of the roof boards in an eaves side connection of the upper side one thereof and an engagement therebetween.

The fixture may be constructed to include a base section mounted on the roof support means; a first support section horizontally outwardly extending from the first support section through a step formed between the base section and the first support section and adapted to support a ridge side end portion of an eaves side backing member of each adjacent two of backing members arranged under the roof boards; an outward projection section formed at a distal end of the first support section and securely engaged with the roof support means through a holding means; a first stopper section upwardly extending from the projection section and adapted to be abutted against a ridge side end of the eaves side backing member; a second support section inwardly horizontally extending from an upper end of the first stopper section and adapted to support an eaves side end portion of ridge side one of the adjacent two backing members; a second stopper section upwardly extending from the second support section and adapted to abuttedly hold an eaves side end of the ridge side backing member; a third support section inwardly horizontally extending from the second stopper section and adapted to support an eaves side end portion of the upper side roof board; and a bent end section downwardly extending from the third support section and formed into a substantially U-shape so as to be securely held in the eaves side connection of the roof board.

Further, in accordance with a further aspect of the present invention, a method of assembling a roof structure is provided which is carried out by connecting a plurality of roof boards to on another in turn from a ridge side to an eaves side and mounting the roof boards on a roof support means, wherein the roof boards each having a flat surface section, a ridge side connection formed at a ridge side end of said flat surface section and an eaves side connection formed at an eaves side end of said flat surface section. The method comprises the steps of mounting a ridge side rising support means on a roof support means; fixing a holding member on the ridge side rising support means; holding the ridge side connection of uppermost one of the roof boards on the holding member; arranging a backing member under the uppermost roof board; securely abutting an eaves side end of the backing member against a fixture fixed on the roof support means at a position on the eaves side beyond the eaves side connection of the uppermost roof board; and connecting the remaining roof boards to one another in turn from the uppermost roof board to the eaves side while repeating the arrangement of backing members and fixtures corresponding to the remaining roof boards.

Accordingly, it is an object of the present invention to provide a roof structure which is capable of being assembled by connecting a plurality of roof boards to one another in turn from a ridge side to an eaves side to accomplish an improvement in workability.

It is another object of the present invention to provide a roof structure which is capable of being assembled by connecting roof boards to one another in turn from a ridge side to an eaves side to eliminate the looseness and movement between the roof boards connected to each other, to thereby prevent leakage of rain.

It is another object of the present invention to provide a roof structure which is capable of being assembled from a ridge side to an eaves side with a simple operation.

It is a further object of the present invention to provide a roof structure which is capable being assembled without using scaffolding and damaging roof boards.

It is still another object of the present invention to provide a fixture for a roof structure which is capable of permitting a plurality of roof boards to be efficiently and rigidly connected to one another in turn from a ridge side to an eaves side to accomplish an improvement in workability and prevent leakage of rain.

It is yet another object of the present invention to provide a fixture for a roof structure which is capable of accomplishing the above-described object with a simple structure.

It is still a further object of the present invention to provide a method of assembling a roof structure from a ridge side to an eaves side which is capable of assembling the roof structure with safety and good workability It is yet a further object of the present invention to provide a method of assembling a roof structure from a ridge side to an eaves side which is capable of providing the roof structure with satisfied waterproofness.

Still other objects and advantages of the present invention will in part be obvious and will in part be apparent from the specification.

The invention accordingly comprises the features of construction, combination of elements, and arrangement of parts, the several steps and the relation of one or more such steps with respect to each of the others, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings in which like reference numerals designate like or corresponding parts throughout, wherein.

DETAILED DESCRIPTION OF THE PREFERRED EMBODIMENTS

Now, the present invention will be described hereinafter with reference to embodiments shown in the accompanying drawings.

Figure 1:
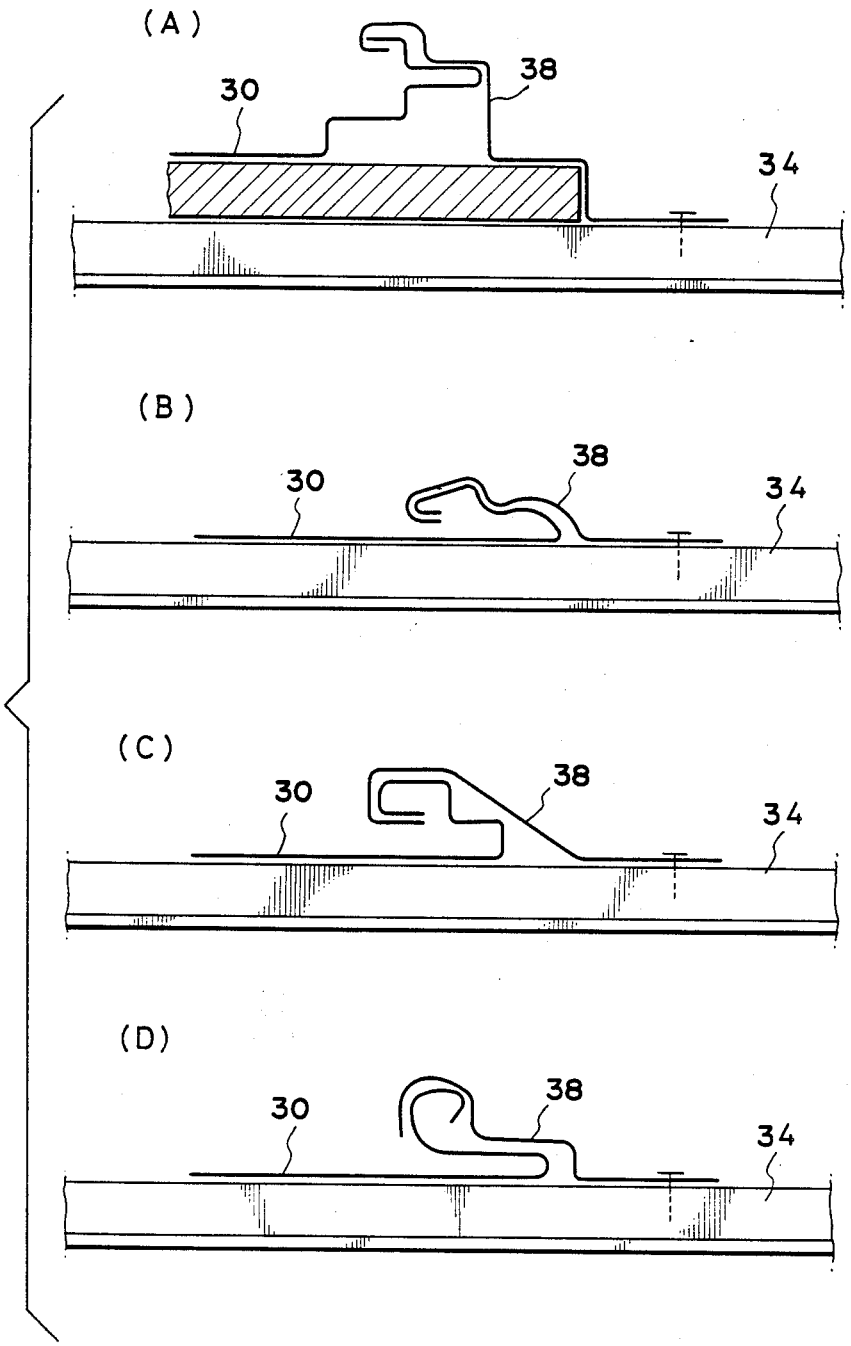
FIG. 1 PRIOR ART
FIGS. 1(A) to 1(B) each are a schematic view showing a conventional roof structure assembled from an eaves side to a ridge side.
Figure 2:
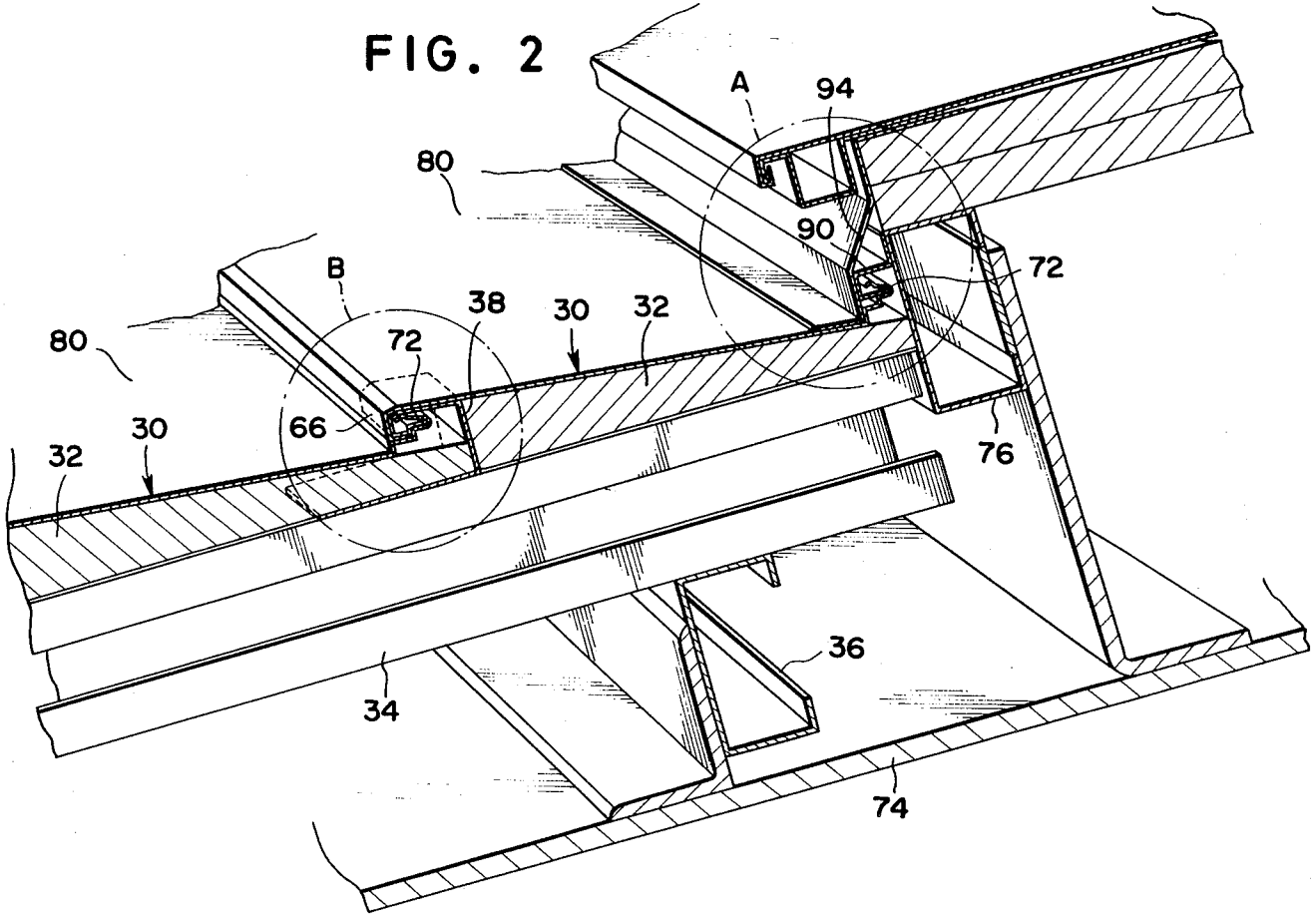
FIG. 2 is a sectional perspective view showing an essential part of an embodiment of a roof structure according to the present invention.

FIG. 2 shows an embodiment of a roof structure according to the present invention which is assembled according to procedures described hereinafter. In FIG.

2, reference numeral 74 designates a roof support member, on which purlins 36 are mounted. Supported on the purlins 36 are common rafters 34 each comprising a channel member of a C-shape in section. The common rafters 34 may be formed into any other suitable shape such as a hat shape in section, a shape provided with a step, or the like. On the common rafters 34 are arranged a plurality of roof boards 30 which are connected to one another in order from a purlin 76 constituting a ridge side rising support means to an eaves side. The roof structure also includes a backing member 32 comprising an excelsior board arranged under each of the roof boards 30.

Figure 5:
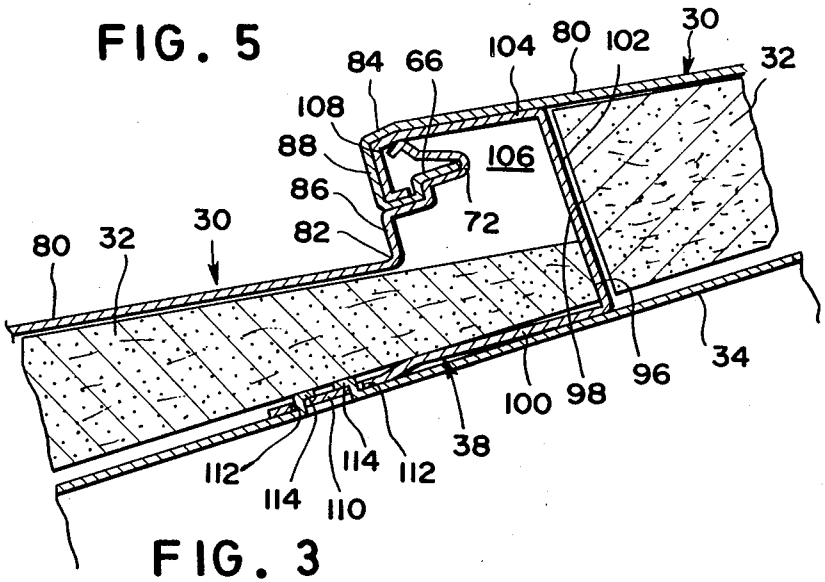
FIG. 5 is an enlarged sectional view showing a section indicated at B in FIG. 2.
Figure 3:
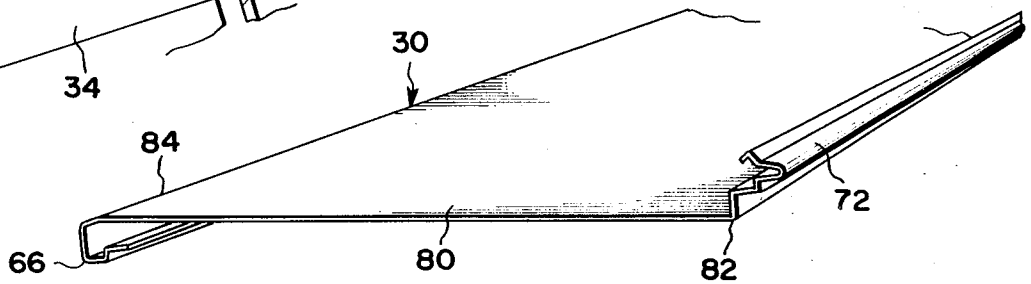
FIG. 3 is a partially perspective view of each of roof boards used in the embodiment shown in FIG. 2.

The roof board 30, as shown in FIG. 2, may be formed by subjecting a lengthwise steel sheet of a predetermined width, to which baking finish for rust prevention was applied, to a shaping treatment using a suitable forming machine, so that it may have a flat surface section 80, an upper side or ridge side connection 72 formed at one end 82 of the flat surface section 80 and a lower side or eaves side connection 66 formed at the other end 84 thereof. The so-shaped steel sheet is then cut into roof boards of a required width. The ridge side connection 72 and eaves side connection 66 of each of the roof boards 30 are constructed to be engaged with each other. Also, each of the roof boards 30, as clearly shown in FIG. 5, is provided with a rising portion 86 which upwardly extends from the one end 82 of the flat surface section 80 to the ridge side connection 72 and a falling section 88 which downwardly extends from the other end 84 of the flat surface section 80 to the eaves side connection 66 and is adapted to be abutted against a rising section 86 of a lower adjacent roof board 30 in a manner to form a flat vertical surface together. Such construction of the roof board allows rainwater to downwardly flow along the so-formed vertical surface to prevent it from entering through an engagement between the ridge side connection 72 of the lower side one of each adjacent two roof boards 30 and the eaves side connection 66 of the upper side roof board 30, so that waterproofness of the engagement may be more efficiently improved.

Figure 4:
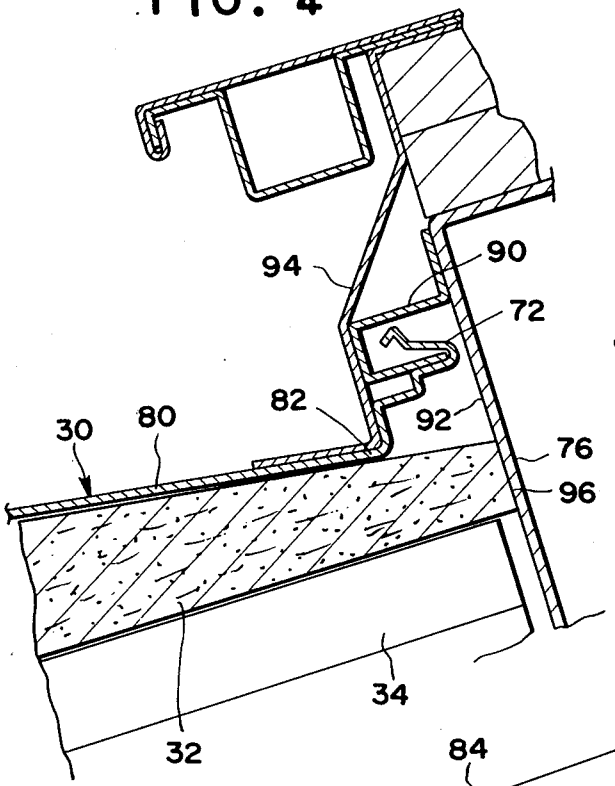
FIG. 4 is an enlarged sectional view showing a section indicated at A in FIG. 2.

Uppermost one of a plurality of the roof boards 30 connected together in order from the ridge side to the eaves side, as shown in FIG. 4, is held at the ridge side connection 72 on a holding member 90 fixed on a vertical surface 92 of the purline or ridge side rising support means 76 utilizing any suitable means such as screws, welding or the like. The ridge side connection 72 and holding member 90 are covered with a water seal member 94 to prevent rainwater from entering through the ridge side connection 72 of the uppermost roof board 30 into the roof structure.

The eaves side connection 66 of the uppermost roof board 30, as shown in FIG. 5, is engagedly connected to the ridge side connection 72 of the lower adjacent roof board 30 through a fixture 38 fixed on the common rafter 34 at a position on the eaves side beyond the eaves side connection 66 of the uppermost roof board 30. Between the lower adjacent roof board 30 and the common rafter 34 is inserted a backing member or excelsior board 32 in such a manner that a ridge side end 96 thereof is abutted against the fixture 38.

Figure 6:
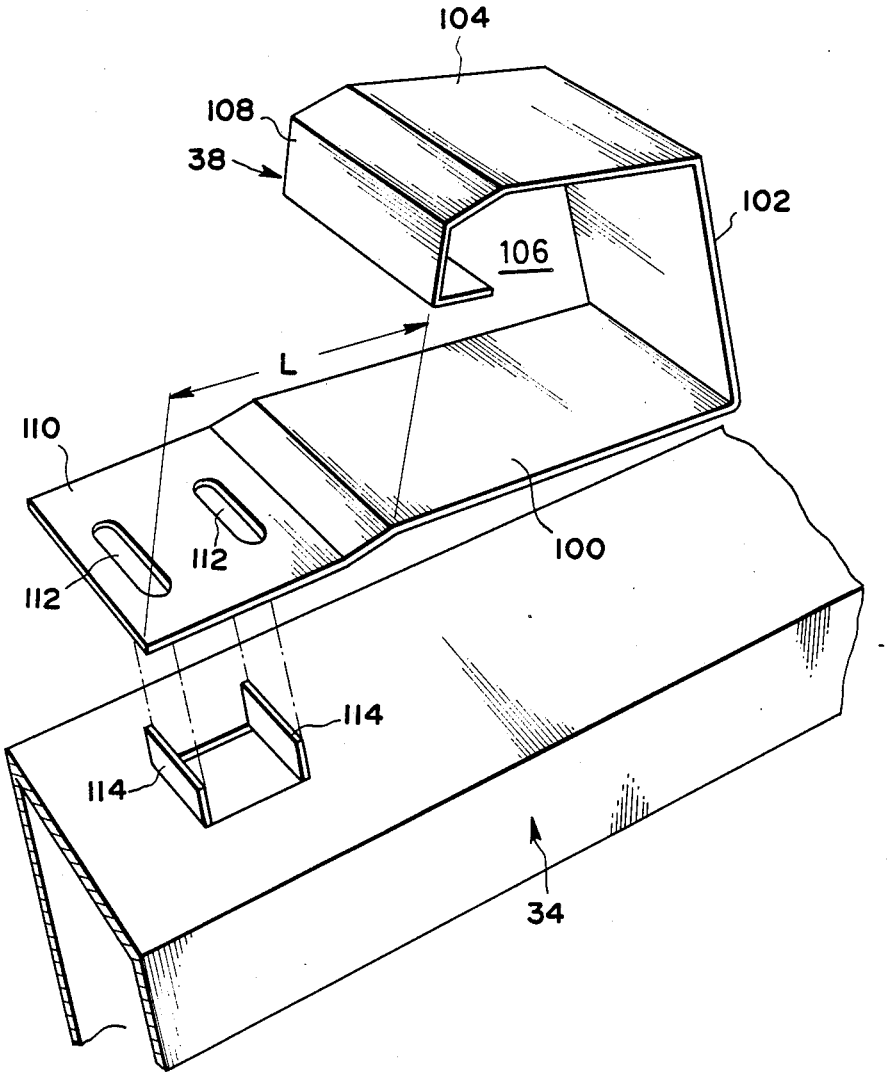
FIG. 6 is an exploded perspective view showing the manner of fixing of a fixture on a common rafter.

The fixture 38, as shown in FIG. 6, is integrally formed into a substantially C shape to have a base section 100 adapted to be mounted on the common rafter 34, a holding section 102 vertically extending from the base section 100 and a support section 104 extending substantially in parallel with the base section 100 and in substantially the same direction as the base section 100 from the holding section 102. The support section 104 is formed at a free end portion 108 thereof into a substantially C-shape. In the illustrated embodiment, the C-shape end portion 108 of the support section 104 is connected through an obliquely downwardly and outwardly extending portion to the support section. Also, the fixture 38 is formed to have an internal space 106 sufficient to cause the insertion of the ridge side connection 72 of the lower side roof board 30 into the eaves side connection 66 of the upper adjacent roof board 30 and the holding of the former with respect to the latter to be readily carried out.

The so-constructed fixture 38 is fixed on the common rafter 34 subsequent to the arrangement of the backing member or excelsior board 32 under the roof board 30, so that the holding section 102 may be abutted against an eaves side end 98 of the upper adjacent excelsior board 32 and the support section 104 supports thereon the other end portion 84 of the upper adjacent roof board 30. Also, the free end 108 of the support section 104 of the fixture 38, as described above, is downwardly bend into a substantially L-shape, resulting in the free end 108 being fixedly engaged with the eaves side connection 66 of the roof board 30. Also, in the illustrated embodiment, the base section 100 of the fixture 38 is formed at an eaves side end 110 thereof with a pair of mounting holes 112 and correspondingly the common rafter 34 is previously provided with a pair of raised projections 114, so that the mounting and positioning of the fixture 38 with respect the common rafter 34 may be carried out by fitting the raised projections 114 in the mounting holes 112 and then bending the raised projections 114 as shown in FIG. 5. Further, in the illustrated embodiment, the fixture 38 is so constructed that the eaves side end 110 of the base section 100 outwardly projects from the free end 108 of the support section 104 to cause the fixture to be fixed on the common rafter at a position on the eaves side beyond an engagement between the ridge side connection of the lower side roof board and the eaves side connection of the upper side roof board. Such construction of the fixture 38 causes the fixture mounted on the common rafter 34 to exhibit satisfied strength.

The fixing of the fixture 38 onto the common rafter 34 may be carried out in a manner different from the foregoing. For example, in a simple roof wherein backing members such as veneered woods are directly mounted on purlins without using any common rafter, the fixture 38 may be fixed directly on the backing member by means of screws, nails or the like. Also, in a roof in which concrete support members are directly laid on a roof frame, the fixture 38 may be fixed directly on the concrete support member.

Now, the manner of assembling of the roof structure will be described with reference to FIGS. 7 to 13.

Figure 9:
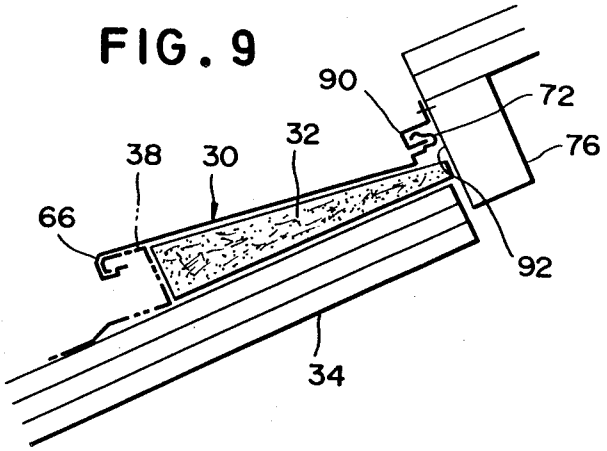
FIGS. 7 to 12 are schematic views showing procedures for assembling a roof structure of the present invention.
Figure 10:
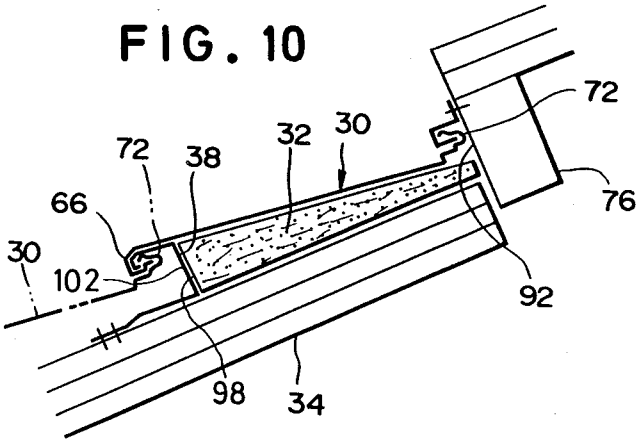
Figure 7:
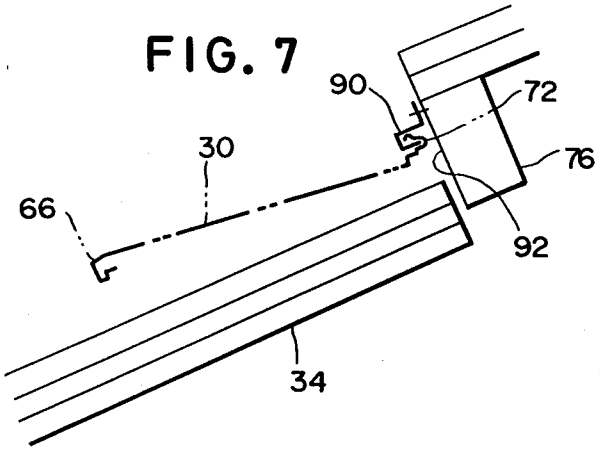
Figure 8:
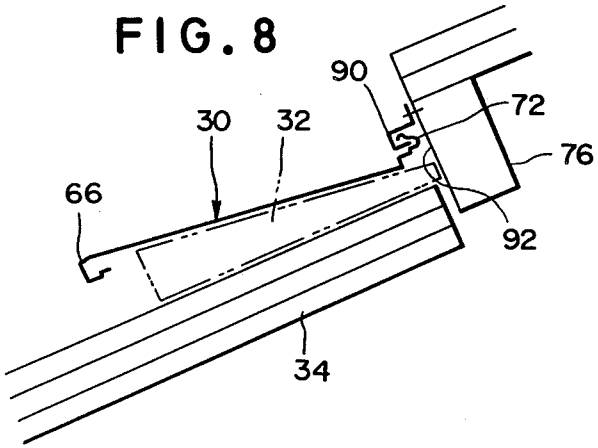
Figure 11:
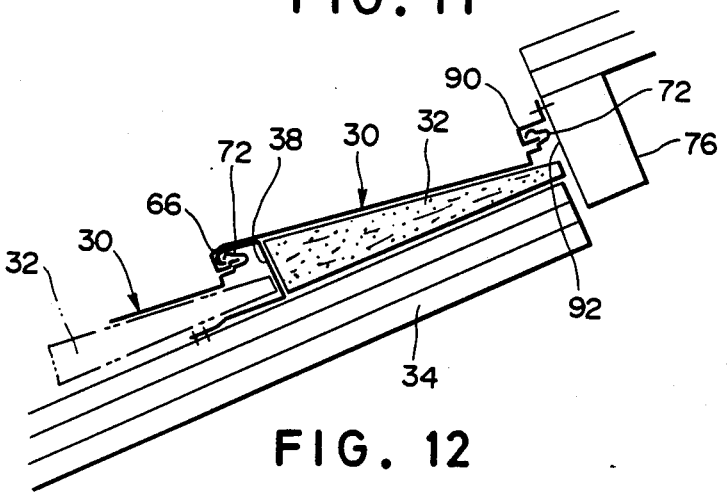
Figure 12:
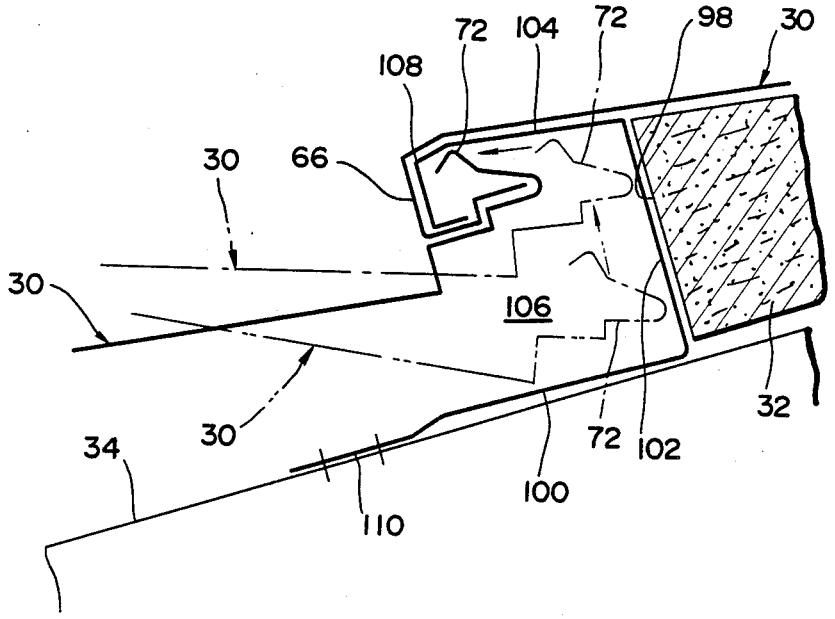

First, as shown in FIG. 7, the holding member 90 is fixedly mounted on the vertical surface 92 of the ridge side rising support means 76 by means of screws or the like, and then the uppermost roof board 30 is securely held at the ridge side connection 72 on the holding member 90 as shown in FIG. 8. Subsequently, the backing member or excelsior board 32 is inserted between the uppermost roof board 30 and the common rafter 34 from the eaves side as shown in FIG. 9 and then the fixture 38 is positioned and fixed on the common rafter 34 in a manner to be abutted at the holding section 102 against the eaves side end 98 of the excelsior board 32 as shown in FIG. 10, so that the excelsior board 32 may be held in position. Concurrently, the eaves side end portion 84 of the uppermost roof board 30 is held on the fixture 38. Thereafter, as shown in FIG. 12, the ridge side connection 72 of the lower adjacent roof board 30 is engagedly inserted in the eaves side connection 66 of the uppermost roof board 30 supported on the fixture 38 and then the lower adjacent excelsior board 32 is interposedly arranged between the lower adjacent roof board 30 and the common rafter 34 and fixed in place by a lower adjacent fixture 38. Such procedures are repeated in turn, so that a plurality of the roof boards 30 may be connected to one another in turn from the ridge side to the eaves side and mounted on the common rafters. The engagement between each adjacent two of the roof boards, as shown in FIG. 12, is made by inserting the ridge side connection 72 of the lower side roof board 30 in the eaves side connection 66 of the upper side roof board 30 supported on the fixture 38 and carrying out the rotation and drawing of the ridge side connection 72 of the lower side roof board as indicated at dashed lines and two-dot chain lines, respectively. Such engagement can be smoothly performed because the internal space 106 of the fixture 38 is sufficient to facilitate the operation.

Figures 13, 14:
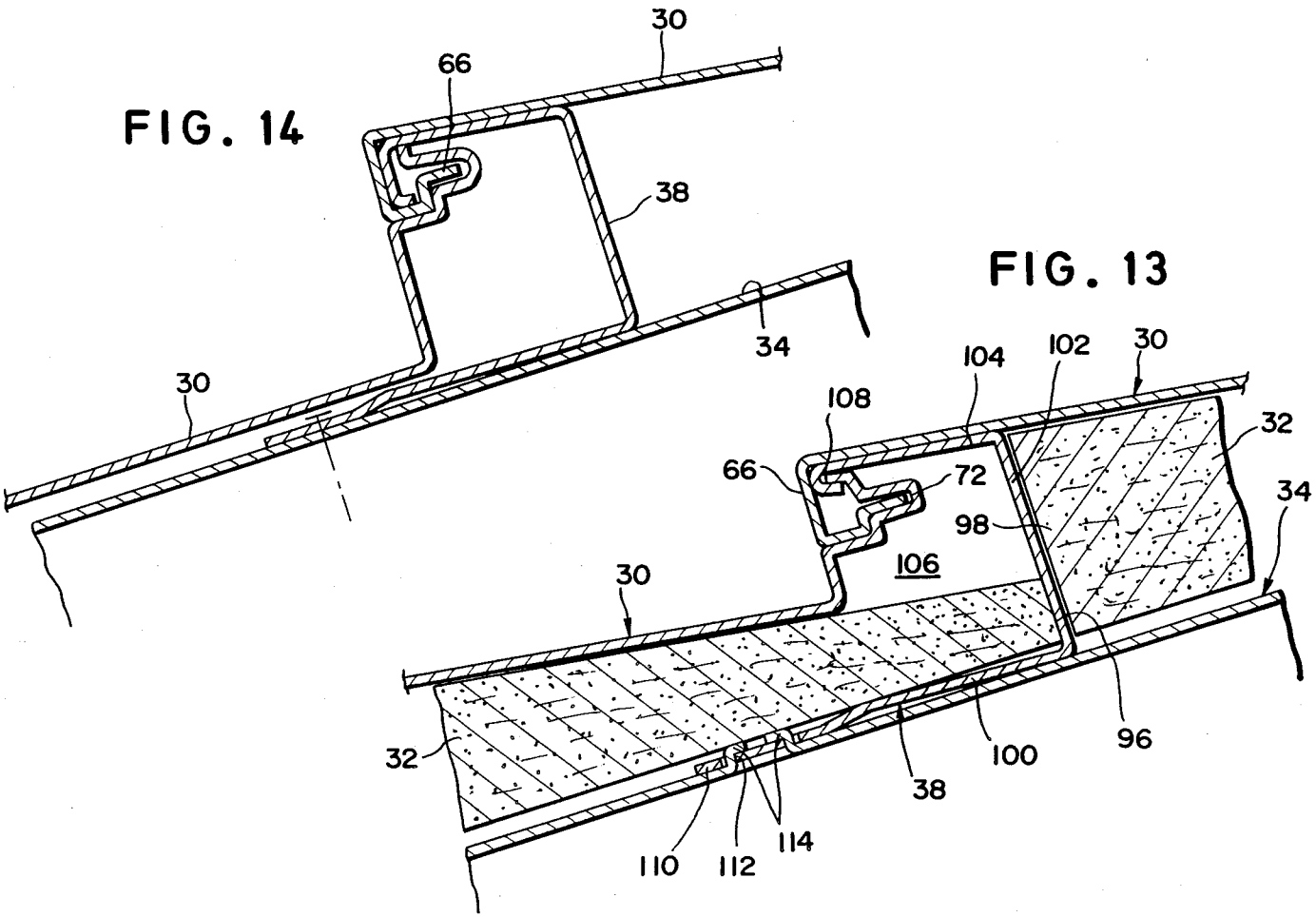
FIG. 13 is an enlarged sectional view showing an essential part of a modification of the embodiment shown in FIG. 2.
FIG. 14 is an enlarged sectional view showing an essential part of a modification of the embodiment shown in FIG. 2.

In the embodiment described above, the fixture 38 is fixedly engaged with the eaves side connection 66 of the corresponding roof board 30. However, it, as shown in FIG. 13, may be engaged with the ridge side connection 72 of the lower adjacent roof board 30. Also, in the illustrated embodiment, the mounting of the fixture 38 with respect to the common rafter 34 is carried out by inserting the raised projections 114 into the mounting holes 112 and bending the raised projections 114. However, it may be practiced using any other suitable means such as screws, rivets or the like.

FIG. 14 shows a modification of the embodiment described above, in which a fixture 38 is used in a roof structure assembled without using a backing member or excelsior board and fixed on the common rafter 34 by means of nails. The remaining of the modification of FIG. 14 may be constructed in a manner similar to the embodiment described above.

The fixture of the present invention, so long as roof boards each is adapted to be engaged with the free end 108 of the fixture, is capable of connecting the roof boards to one another in order from the ridge side to the eaves side, even when the roof boards are originally made to be connected from the eaves side to the ridge side. Thus, it will be noted that the present invention is effectively applicable to conventional roof boards.

As can be seen from the foregoing, the illustrated embodiment is so constructed that a plurality of the roof boards are connected to one another in turn from the ridge side to the eaves side and mounted through common rafters on purlins, and the fixture securely holds therein the eaves side connection and ridge side connection of each adjacent two of the roof boards which have engaged with each other. Also, the fixture holds the eaves side end of the backing member inserted under the roof board. Accordingly, the illustrated embodiment not only facilitates the transfer of the roof boards but causes the assembling operation to be readily carried out without requiring scaffolding and injuring the roof boards irrespective of a steep slant, as compared to the prior art in which roof boards are connected to one another from the eaves side to the ridge side. Also, the fixture is formed to have an sufficient internal space, so that the assembling operation may be more smoothly and efficiently accomplished. Furthermore, the illustrated embodiment can be practiced without skill and at low costs.

Also, in the illustrated embodiment, the fixture is fixed on the common rafter at a position on the eaves side beyond the eaves side connection of the corresponding roof board, resulting in the strength of the fixture mounted on the common rafter being highly increased to a degree sufficient to bear force of blowing-up wind which is to peel the fixture together with the roof board from the common rafter, so that the roof structure may be rigidly constructed.

Figures 15, 16:
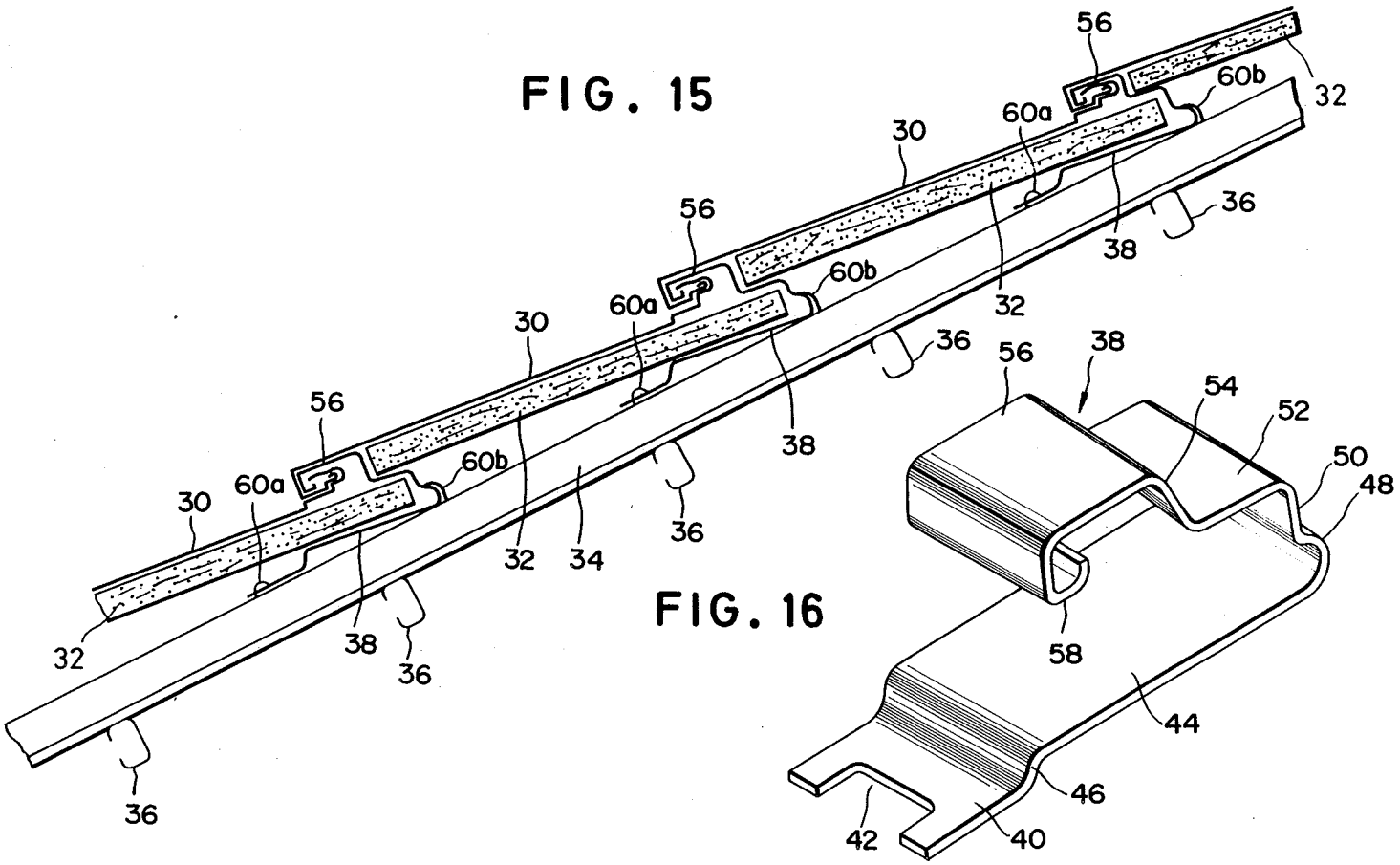
FIG. 15 is a sectional view showing another embodiment of a roof board according to the present invention.
FIG. 16 is a perspective view showing a fixture used in the embodiment shown in FIG. 15.

FIG. 15 shows another embodiment of a roof structure according to the present invention. In the embodiment shown in FIG. 15 a plurality of roof boards 30 are connected to one another in turn from a ridge side to an eaves side while being securely mounted in turn through backing members 32 on common rafters 34 of a hat shape in section perpendicularly fixed at a predetermined slant on purlins or C-shaped channel members 36 formed of iron, by means of fixtures 38 securely mounted on the common rafters 34 which serve to fix the roof boards 30 and backing members 32 with respect to the common rafters 34.

The fixture 38 may be formed by subjecting a galvanized sheet of a large thickness to pressing. The fixture 38, as shown in FIG. 16, is formed into a substantially C-shape so as to comprise a base section 40 formed with an engagement recess 42, a first support section 44 formed to horizontally extend from the base section 40 with a step 46 being defined therebetween, an outward projection section 48 formed at a distal end of the first support section 44, a first stopper section 50 formed to upwardly extend from the projection section 48, a second support section 52 formed to inwardly horizontally extend from the first stopper section 50, a second stopper section 54 formed to upwardly extend from the second support section 52, a third support section 56 formed to inwardly horizontally extend from the second stopper section 54, and a bent end section 58 downwardly extending from the third support section 56 and formed into a substantially U-shape. In the illustrated embodiment, the base section 40 is formed to outwardly project from the bent end section 58, as shown in FIG. 16.

The fixture 38 constructed as described above, as shown in FIG. 17, is held on a common rafter 34 through a pair of pawls 60*a* and 60*b* formed by raising a part of the common rafter 34 and fixed thereon by securely engaging the pawls 60*a* and 60*b* with the engagement recess 42 of the base section 40 and the projection section 48 by caulking, respectively. With respect to the fixture 38 fixed on the common rafter 34 in such a manner, lower one of each adjacent two backing members 32 is inserted at a ridge side end portion 62 thereof between the first and second support sections 44 and 52 of the fixture 38 to abut a ridge side end against the first stopper section 50 and the upper side backing member 32 is supported at an eaves side end portion 64 thereof on the second support section 52 and abutted at an eaves side end thereof against the second stopper section 54.

Further, each of the roof boards 30 is so constructed that an eaves side connection 66 is inwardly bent at an end section 68 thereof to surround the bent end section 58 of the fixture 38 and the inwardly bent end portion 68 of the eaves side connection 66 is fitted in an outer end portion 70 of a ridge side connection 72 of the lower adjacent roof board 30.

Figure 17:
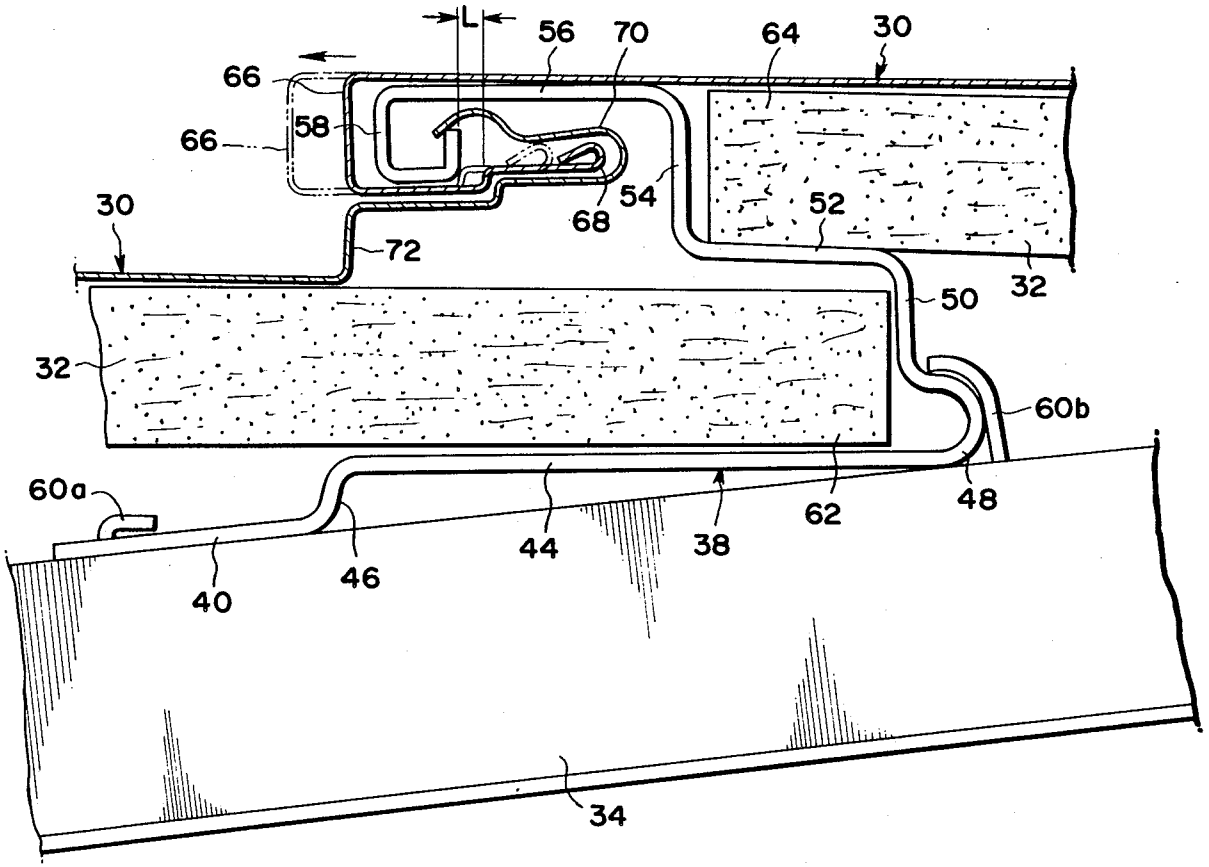
FIG. 17 is an enlarged sectional view showing an essential part of the roof structure shown in FIG. 15.
Figure 18:
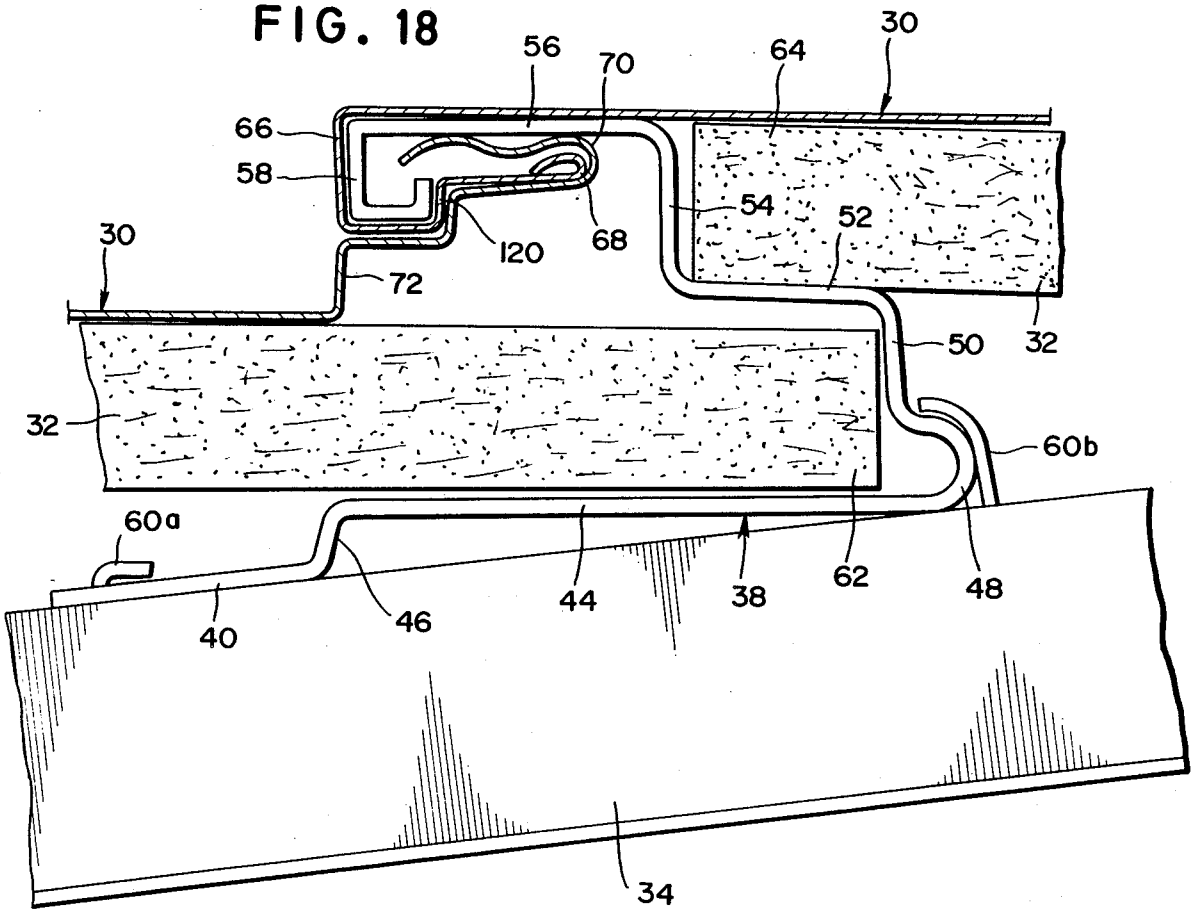
FIG. 18 is an enlarged sectional view showing an essential part of a modification of the embodiment shown in FIG. 15.

FIG. 18 shows a modification of the roof structure shown in FIGS. 15 to 17. In the embodiment shown in FIGS. 15 to 17, as described above, the eaves side connection 66 of the roof board 30 is adapted to engagedly surround the bent end section 58 of the fixture 38. Although this effectively prevents the lifting of the roof board 30 due to force of blowing-up wind; the upper side one of each adjacent two roof boards 30 is apt to be moved at the eaves side connection toward the eaves side as indicated at two-dot chain lines in FIG. 17, for example, when a worker is on the roof board; because a gap L is formed between the eaves side connection 66 of the roof board 30 and the bent end section 58 of the fixture 38. This occasionally fails to provide the roof structure with rigidity and waterproofness.

The modification of FIG. 18 is for the purpose of eliminating such a disadvantage of the embodiment shown in FIGS. 15 to 17.

The embodiment shown in FIG. 18 is constructed in such a manner that each of roof boards 30 is provided at an intermediate region of an inwardly bent end section 68 of an eaves side connection 66 thereof with a stepped engagement portion 120 having a rising surface, so that a fixture 38 may be engagedly abutted at a bent end section 58 thereof against the stepped engagement portion 120. Such construction effectively prevents an upper side one of adjacent two roof boards 30 from being moved toward an eaves side with respect to a ridge side roof board thereof because the upper side roof board can be securely held with respect to the lower side roof board due to the secure engagement between the bent end section 58 of the fixture 38 and the stepped engagement portion 120 of the eaves side connection 66 of the upper side or ridge side roof board 30.

The remaining of the modification of FIG. 18 may be constructed in substantially the same manner as the roof structure shown in FIGS. 15 to 17.

Figure 19:
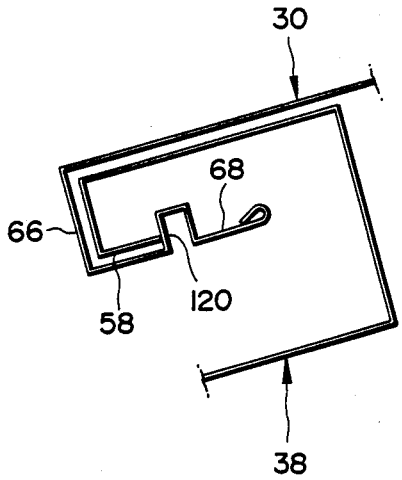
FIGS. 19 to 22 each are a schematic view showing a further modification of the roof structure of FIG. 18 in which the abutment between a fixture and a roof member is made in a different manner.
Figure 20:
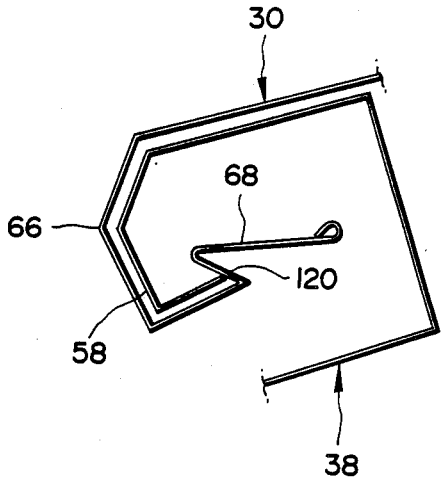
Figure 21:
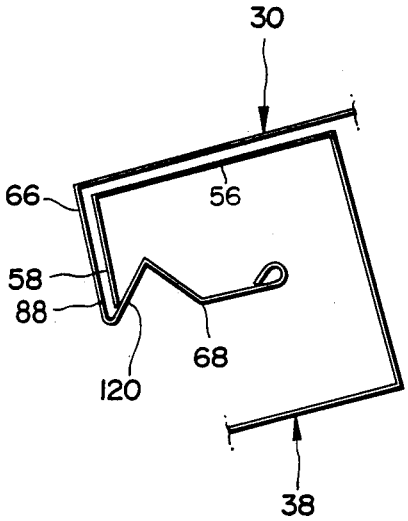
Figure 22:
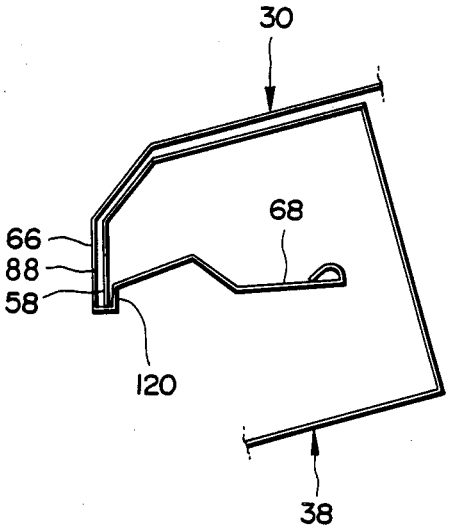

FIGS. 19 to 22 each show a modification of the roof structure shown in FIG. 18, wherein the manner of abutment between a bent end section 58 of a fixture 38 and a stepped engagement 120 formed at an inwardly bent end section 68 of an eaves side connection 66 of a roof board 30 is modified. More particularly, the modification shown in FIG. 19 is so constructed that a bent end section 58 of a fixture 38 is formed into an L-shape and a stepped engagement portion 120 of an inwardly bent end section 68 of an eaves side connection 66 is formed into a substantially inverted U-shape. In the modification of FIG. 20, a bent end section 58 of a fixture 38 comprises a downwardly obliquely extending portion and an L-shaped portion connected thereto, and a stepped engagement portion 120 of an inwardly bent end section 68 of an eaves side connection 66 is formed to be obliquely upwardly projected toward the bent end section 58. The modification shown in FIG. 21 is constructed in such a manner that a bent end section 58 is formed to downwardly extend from a third support section 56 and a stepped engagement portion 120 is formed into a triangle shape to securely interpose a distal end of the bent end section 58 between a falling section 88 and the stepped engagement portion 120. The modification of FIG. 22 is so constructed that a bent end section 58 comprises an obliquely downwardly and outwardly extending portion and a downwardly extending portion connected thereto and a stepped engagement portion 120 is provided in proximity to the a falling section 88 to securely interpose a lower end of the downwardly extending portion of the bent end section 58 between the falling section 88 and the stepped engagement portion 120.

It will be noted that each of the modifications likewise effectively prevents an upper side one of adjacent two roof boards 30 from being moved toward an eaves side with respect to a ridge side roof board thereof.

It is a matter of course that the illustrated embodiment is not limited to the above description. The fixture and roof board in the roof structure of the illustrated embodiment may be modified in other different manners depending upon workability required.

As can be seen from the foregoing, in the roof structure of the modification shown in FIG. 18, a plurality of the roof boards are connected to one another in turn from the ridge side to the eaves side and mounted on a roof support means in turn by means of the fixtures. Also, the fixtures each are constructed to be engagedly abutted at the bent end section thereof against the stepped engagement portion formed at the inwardly bent end section of the eaves side connection of the roof board. Accordingly, the roof structure of the embodiment can be readily assembled as compared with the conventional one assembled by connecting roof boards to one another in turn from the eaves side to the ridge side. Also, the roof structure of the embodiment effectively prevents the looseness and movement of the roof board toward to the eaves side.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method of assembling a roof structure formed of a plurality of roof boards extending at a downward incline from a ridge to an eave by connecting said plurality of roof boards to one another in adjacent side by side relation between the ridge and the eave and mounting the roof boards on a roof support means, said roof boards each having a flat surface section, a ridge side connection portion formed at the side of the flat surface section facing the ridge and an eaves side connection portion formed at the side of the flat surface section facing the eave comprising the steps of:

mounting a rising ridge side support means on said roof support means;

fixing a holding member on said rising ridge side support means;

holding the ridge side connection portion of the roof board of the plurality of boards closest the ridge on said holding member;

arranging a backing member having an eaves side end closest the eave and a ridge side end closest the ridge under said roof board closest to the ridge;

securely abutting the eaves side end of said backing member against a fixture fixed on said roof support means at a position on the eaves side of the backing member beyond said eaves side connection of said roof board closest to the ridge to the roof board closest to the eave and;

repeating the above steps on the backing members, the fixture and the plurality of roof boards until said roof structure is complete.

* * * * *